US005104114A

United States Patent [19]

Gillmann

[11] Patent Number: 5,104,114

[45] Date of Patent: Apr. 14, 1992

[54] STACKING DEVICE WITH CONTAINER HAVING MOVABLE BOTTOM

[75] Inventor: Hanno Gillmann, Konstanz, Fed. Rep. of Germany

[73] Assignee: Licentia Patent-Verwaltungs-GmbH, Frankfurt, Fed. Rep. of Germany

[21] Appl. No.: 379,122

[22] Filed: Jul. 13, 1989

[30] Foreign Application Priority Data

Jul. 13, 1988 [DE] Fed. Rep. of Germany ..... 3823644

[51] Int. Cl.[5] ..... B65H 29/00

[52] U.S. Cl. ..... 271/181; 271/213; 271/214

[58] Field of Search ..... 271/213, 214, 215, 177–181, 271/163, 149, 162, 2, 1, 207; 414/788.1, 792.7, 794.9; 53/542, 475

[56] References Cited

U.S. PATENT DOCUMENTS

| | | | |
|---|---|---|---|
| 3,404,882 | 10/1968 | Hecker et al. | 271/163 |
| 3,865,365 | 2/1975 | Hardin et al. | 271/214 |
| 4,518,160 | 5/1985 | Lambrechts et al. | 271/214 |
| 4,718,657 | 1/1988 | Otter et al. | 271/215 X |

FOREIGN PATENT DOCUMENTS

| | | | |
|---|---|---|---|
| 1136277 | 9/1962 | Fed. Rep. of Germany | 271/86 |
| 69162 | 5/1980 | Japan | 271/207 |
| 221050 | 10/1986 | Japan | 271/207 |
| 27273 | 1/1987 | Japan | 271/215 |

*Primary Examiner*—David H. Bollinger
*Attorney, Agent, or Firm*—Spencer & Frank

[57] ABSTRACT

A device for stacking flat objects directly into a container. The container includes a movable bottom which constitutes the stack bottom during a stacking process.

13 Claims, 1 Drawing Sheet

STACKING DEVICE WITH CONTAINER HAVING MOVABLE BOTTOM

CROSS REFERENCE TO RELATED APPLICATION

This application claims the priority of application Ser. No. P 38 23 644.3 filed July 13th, 1988, in the Federal Republic of Germany, the subject matter of which is incorporated herein by reference.

BACKGROUND OF THE INVENTION

The present invention relates to a container for receiving stacks of flat objects such as, for example, items of mail, and additionally to a device for the direct stacking of flat objects into containers.

Stacking devices and stack containers are used in mail distribution systems. In the simplest case, items are stacked into stack compartments having fixed stack bottoms and side walls. Drawer-like receiving devices for containers are disposed below respective compartments. To transfer a stack into a container, an operator pulls out the drawer with the container on it and moves the stack manually into the container. This can be accomplished in the simplest case by the operator gripping the stack, or only part of it, with both hands and lowering it into the stack container. This involves the danger that, in the course of the lowering process, the stack becomes disarranged and falls apart and must be reassembled manually.

A device for the direct stacking of mail items into containers in which this danger is avoided is disclosed in European Patent No. 0,049,718 and its counterpart U.S. Pat. No. 4,518,160. Here, a movable tongue co-operating with a fixed stack bottom projects into the container so that the stack is introduced into the container relatively smoothly. One drawback of this device, however, is that the movable tongue must be pulled out of the container and the container cannot be filled to the top.

SUMMARY OF THE INVENTION

It is an object of the present invention to provide a stack container and a stacking device which permit direct stacking of flat objects into the stack container and thus avoid the stated drawbacks of the prior art device.

The above and other objects are accomplished in accordance with the principles of the invention by the provision of a container in the context of a device as first described above wherein the container has a movable bottom which constitutes the stack bottom during a stacking process.

BRIEF DESCRIPTION OF THE DRAWINGS

The invention will now be described in greater detail with reference to the drawing figures, wherein.

DETAILED DESCRIPTION OF THE PREFERRED EMBODIMENTS

While the prior art solutions employ standard containers having fixed walls and a fixed bottom, the present invention provides a movable bottom for the container. During stacking, this movable bottom constitutes the container bottom onto which the stack material is stacked and by which it is supported. For removal of a stack from a stack container constructed according to the invention, the stack container is removed from the stacking device and during this process the movable stack bottom is lowered. With the lowering of the stack bottom, the stack is simultaneously lowered into the container. The necessity of reloading the stack into a container from an already loaded compartment as previously described, and the danger of changes to the stack are eliminated.

Figure 1:
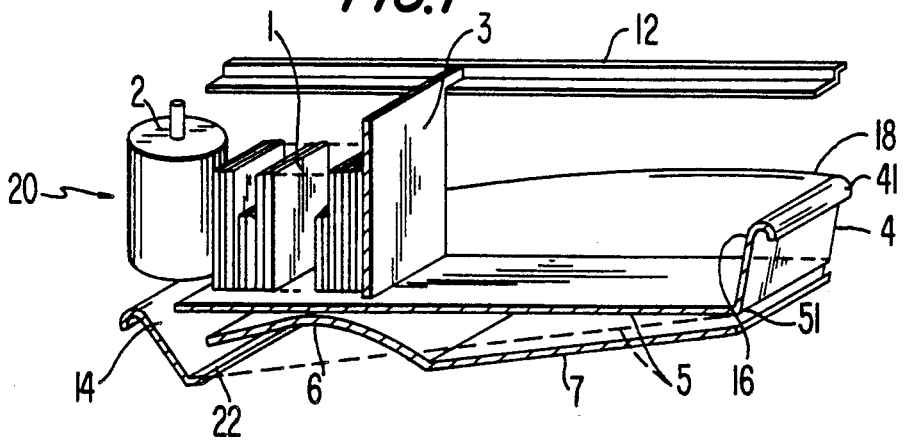
FIG. 1 is a schematic sectional view of a stacking device according to the invention having an asymmetrical stack container.

Referring to FIG. 1, there is shown an embodiment of a stacking device 20 according to the invention wherein a stack of mail 1 is shown being stacked on edge by a stacking roller 2 against a supporting wall 3 in container 4. The details of the stacking roller are well known and need not be discussed here. Supporting wall 3 is linearly movable along a guide rod 12 and is provided with a pulling device (not shown) which produces a certain stacking pressure so that the stack does not fall down. Supporting wall 3 can be removed upwardly to be reused at the beginning of the stack so that the stack can then be removed from container 4. The position of supporting wall 3 is sensed by position detectors (not shown) which actuate displays (not shown) to signal to the operator that the stack is full and a new container should be used. Container 4 has fixed front and rear walls 14 and 16, respectively, and side walls 18, only one of which is shown in FIG. 1. Rear wall 16 is provided with gripping recess 41. A movable container bottom 5 is fastened to a hinge 51. During a stacking process, bottom 5 simultaneously is the bottom of the stack. Container 4 may also have a fixed bottom (not shown) which is provided with openings through which there projects a supporting device, which in FIG. 1 is shown as a leading ramp 6, for supporting movable container bottom 5 during a stacking process. If a fixed bottom is absent, means are provided at the front, rear and/or side walls on which movable bottom 5 is able to rest, such as a lip 22 projecting from the lower portion of front wall 14.

When container 4 is introduced into stacking device 20 and is in the operating position, it is slightly inclined relative to the horizontal so that the end wall adjacent stacking roller 2 is somewhat lower than the end wall remote from roller 2; thus, in the case of FIG. 1 front wall 14 is somewhat lower than rear wall 16. The term "in the operating position" here means the position of the container and its movable bottom while objects are being stacked into the container. Leading ramp 6 causes movable container bottom 5 to be raised slightly when the container is pushed in so that in the operating position, ramp 6 assures that movable container bottom 5 is raised and takes on an approximately horizontal position.

Figure 3:
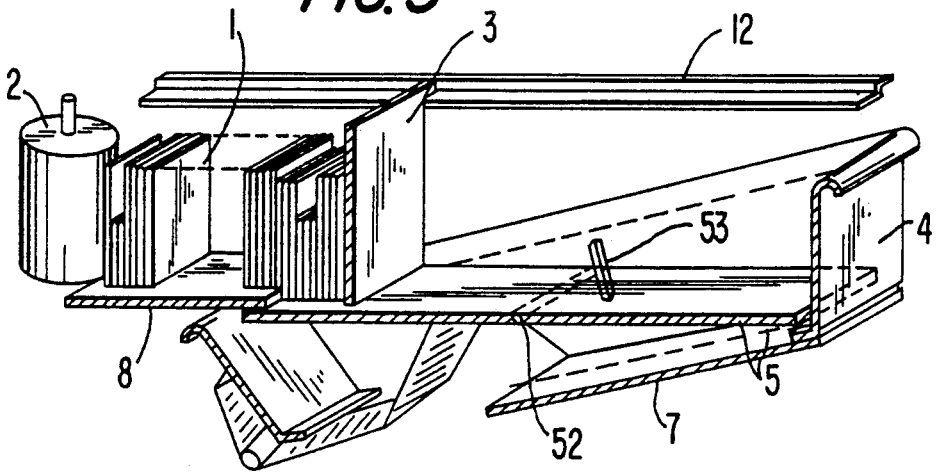
FIG. 3 is a schematic sectional view of further embodiment of a stacking device according to the invention.

According to another embodiment shown in FIG. 3, a lever mechanism is provided which lifts the container bottom from below, with the lifting occurring by way of a lever effect when the front wall of the container is pushed in.

In order for a supporting device, such as ramp 6, to be able to act on movable container bottom 5, appropriate openings must be provided in the fixed container if the latter has a fixed bottom. In the embodiment shown in FIG. 1, ramp 6 is a continuation of a support 7 for container 4. Preferably, the support for container 4 is configured in the manner of a drawer which may be equipped with telescoping rails (not shown) so that the container can be pulled out with little force.

When movable bottom 5 is in the operating position, flat objects 1 can be stacked successively on bottom 5. In this connection, it is of advantage to configure the movable container bottom 5 so that, for example, in its shape and by the suitable selection of its material or by coating it with a suitable material, e.g. Teflon, friction between a stack and the container bottom is as low as possible. Stacking can be continued until wall 3 reaches rear wall 16 and the container is full. If container 4 is now removed from the operating position, i.e. the supporting device for movable bottom 5 is removed, movable bottom 5 is lowered together with the stack.

Figure 2:
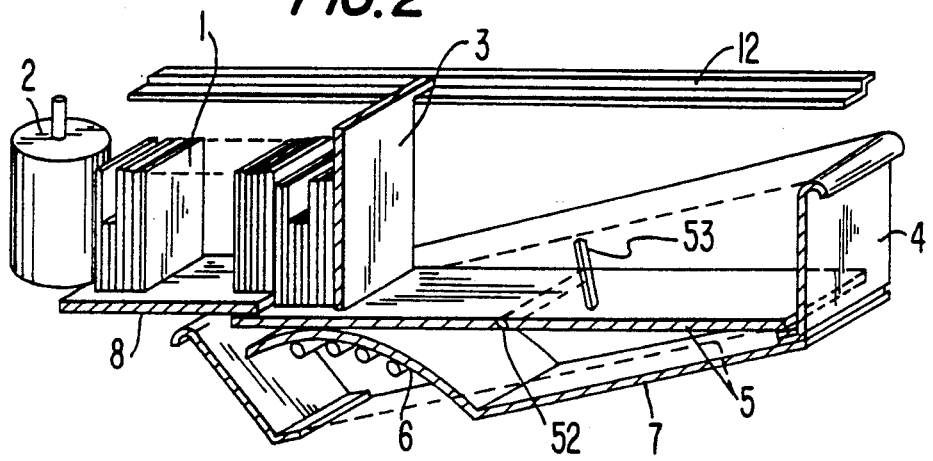
FIG. 2 is a schematic sectional view of another embodiment of a stacking device according to the invention having a symmetrical stack container.

FIG. 2 shows a further embodiment of the invention. In contradistinction to FIG. 1, container 4 is here symmetrical. That is, instead of hinge 51, a hinge 52 is provided which is disposed approximately in the middle of the container between front wall 14 and rear wall 16. Hinge 52, and thus bottom 5, may be given additional vertical play by way of a slot 53 in which hinge 52 may be adjusted in the vertical direction. In the operating position, bottom 5 is tilted about hinge 52 so that bottom 5 is essentially in a horizontal position. This embodiment has the advantage that either end of container 4 can be introduced into the stacking compartment (drawer).

FIG. 2 further shows a fixed stack bottom 8 which is permanently connected with the stacking device, making it possible to stack a smaller stack of objects without a container being introduced. The use of fixed stack bottom 8 has the advantage that the stacking process need not be interrupted when containers are exchanged.

Obviously, numerous and additional modifications and variations of the present invention are possible in light of the above teachings. It is therefore to be understood that within the scope of the appended claims, the invention may be practice otherwise than as specifically claimed.

What is claimed is:

1. In a device for stacking flat objects directly into a container supported in the device, the container including a bottom for supporting a stack of flat objects stacked into the container during a stacking process, the improvement wherein:

said bottom is movable and constitutes the stack bottom during the stacking process; and said device further comprises bottom supporting means for causing said movable stack bottom to lie approximate in a horizontal orientation during the stacking process, wherein said bottom supporting means comprises a ramp.

2. A device as defined in claim 1, wherein said container has a rear side wall, and further comprising a hinge disposed in the vicinity of the bottom of said rear side wall, said movable stack bottom being fastened to said hinge.

3. In a device for stacking flat objects on edge in a container having a bottom for supporting a horizontal stack of the flat objects, the device including container support means for removably supporting the container in the device, the improvement wherein:

the bottom of said container is pivotally mounted in said container; and said container support means includes pivoting means for pivoting said bottom in one position as said container is inserted in said device in an operating position for receiving objects to be horizontally stacked on said bottom during a stacking process and for pivoting said bottom in a second position as said container is removed from said device for transporting the horizontal stack.

4. A device as defined in claim 3, wherein said pivoting means pivots the bottom of said container to lie approximately in a horizontal orientation during the stacking process.

5. A device as defined in claim 3, wherein said pivoting means comprises a ramp.

6. A device as defined in claim 3, wherein said pivoting means comprises a lever mechanism which raises the bottom of said container from below.

7. A device as defined in claim 3, wherein said container includes a rear wall with a lower edge and a hinge connecting said bottom to the lower edge of said rear wall so that said bottom can be pivoted between the first and second positions.

8. A device as defined in claim 3, wherein said container includes front and rear walls and bearing means centrally disposed between said front and rear walls for permitting pivoting of said bottom by one of raising an end region of said bottom adjacent said front wall and by raising an end region of said bottom adjacent said rear wall.

9. In a container having a bottom and being removably inserted in a device for stacking flat objects on edge to form a horizontal stack of the flat objects on the bottom of the container during a stacking process, the improvement wherein:

the bottom of the said container is pivotally mounted in the container for assuming a first position when the container is inserted in the device in an operating position for receiving the flat objects to be stacked and a second position when the container is removed from the device for transporting the stacked objects.

10. A container as defined in claim 9, wherein said container includes a rear wall with a lower edge and a hinge connecting said bottom to the lower edge of said rear wall so that said bottom can be pivoted between the first and second positions.

11. A container as defined in claim 9, wherein said container includes front and rear walls and bearing means centrally disposed between said front and rear walls for permitting pivoting of said bottom by one of raising an end region of said bottom adjacent said front wall and by raising an end region of said bottom adjacent said rear wall.

12. A container as defined in claim 9, wherein said bottom has a surface for supporting the edges of the objects and said surface comprises a material for minimizing friction between the edges of the objects and said bottom.

13. A container as defined in claim 12, wherein said material comprises Teflon.

* * * * *